US008959684B2

(12) United States Patent
Oyo-Hoffmann

(10) Patent No.: US 8,959,684 B2
(45) Date of Patent: Feb. 24, 2015

(54) WALL HUNG SLIPCOVER HEADBOARD TO INCORPORATE ART INTO A BED

(76) Inventor: Astrid Oyo-Hoffmann, Maplewood, NJ (US)

( * ) Notice: Subject to any disclaimer, the term of this patent is extended or adjusted under 35 U.S.C. 154(b) by 0 days.

(21) Appl. No.: 13/537,469

(22) Filed: Jun. 29, 2012

(65) Prior Publication Data

US 2014/0000038 A1 Jan. 2, 2014

(51) Int. Cl.
*A47C 31/00* (2006.01)
*A47C 19/04* (2006.01)

(52) U.S. Cl.
USPC ..... 5/658; 5/183; 5/907

(58) Field of Classification Search
CPC .... A47C 19/022; A47C 19/04; A47C 19/005; A47C 27/085; A47C 20/027; A47C 17/14; A61G 7/05
USPC ..... 5/53.1, 280, 183, 285, 907, 658; D06/505, 506; 160/38, 39
See application file for complete search history.

(56) References Cited

U.S. PATENT DOCUMENTS 2,508,506 A * 5/1950 Fridolph ..... 160/378
2,641,779 A * 6/1953 Gill ..... 5/53.1
3,736,603 A * 6/1973 Rothman ..... 5/53.1
3,774,247 A * 11/1973 Bradley ..... 5/53.2
3,790,973 A * 2/1974 Bradley ..... 5/53.2
3,965,504 A * 6/1976 Ainsworth ..... 5/485
4,821,349 A * 4/1989 Cohen ..... 5/53.1
5,195,195 A * 3/1993 Murray ..... 5/53.1
5,790,994 A * 8/1998 Leonard ..... 5/53.1
6,182,307 B1 * 2/2001 Rutrick ..... 5/53.1
6,371,190 B1 * 4/2002 Owens ..... 160/135
6,618,876 B2 * 9/2003 Murphy et al. ..... 5/53.1
7,024,709 B2 * 4/2006 Moceri ..... 5/482
7,118,179 B1 * 10/2006 Wilson et al. ..... 297/395
8,104,119 B2 * 1/2012 Truex ..... 5/482
2005/0177940 A1 * 8/2005 Moceri ..... 5/482
2008/0313808 A1 * 12/2008 Crue ..... 5/183
2010/0281615 A1 * 11/2010 Truex ..... 5/488
2012/0005835 A1 * 1/2012 Betesh et al. ..... 5/658

* cited by examiner

*Primary Examiner* — Nicholas Polito
*Assistant Examiner* — Eric Kurilla
(74) *Attorney, Agent, or Firm* — Porzio, Bromberg & Newman, P.C.

(57) ABSTRACT

A wall-mounted slipcover headboard for a bed combines comfort of an upholstered headboard with the ease of removable covers while it solves the problem of hanging art above the bed by incorporating art into the bed. The headboard has a modular, frame, a cushioning pad and a removable slipcover. For example, the removable slipcover features printed art. The headboard's back side has horizontal dowels that slide on to a hanging medium, allowing for flexibility in mounting the hanging medium in the strongest place on a wall with the least amount of damage to the wall, while allowing the headboard to slide horizontally to be centered above a bed.

9 Claims, 5 Drawing Sheets

WALL HUNG SLIPCOVER HEADBOARD TO INCORPORATE ART INTO A BED

BACKGROUND OF THE INVENTION

1. Field of the Invention

The present invention relates to bed accessories and more specifically to decorative, lightweight, knock-down slipcovered headboards that accompany, but are not attached to, the supporting structure of the bed. This invention has functional and design advantages over those previously known.

2. Description of Related Art

Each season, individuals and home designers desire to change the look and feel of home interiors, especially the bedroom. Redecorating can be used to transform a dull room into a reflection of personal style. Time, budget and functionality are considerations. This is especially true when the room is a bedroom, the most private room in a home. Bedrooms are considered a place of relaxation and it is, therefore, desirable to redecorate with minimal stress and maximal personality.

Customized home decorating is expensive and requires an interior decorator and purchasing designer furniture, art and other accessories. This may be appropriate for some, but is too costly for most. One decorating option is to achieve the bedroom you want by getting a headboard which allows frequent changes and updates to the décor.

Contemporary bed structures often comprise a bed frame and mattress or a mattress resting on a box spring supported by a frame on legs or wheels. Often, a decorative headboard and/or footboard are attached to either the frame or box spring, or both, to enhance the visual impact of the bed.

Conventional headboards are often attached directly to the frame, upholstered and heavy. This makes them bulky, a pricey investment and "permanent". They offer little flexibility as to changes in decorative taste, the maturing and evolving taste of a child and youth, as well as a lifestyle defined by mobility of individuals when it becomes desirable or necessary to move from one living location to another. A conventional upholstered headboard then triggers storage expenses, creates guilt and buyer's remorse.

A variety of headboard assemblies and decoration choices have been described. Many alternatives are limited in that they require mounting a headboard to an existing bed frame (U.S. Pat. No. 4,821,349 to Cohen; U.S. Pat. No. 5,075,910 to Morten; U.S. Pat. No. 5,195,195 to Murray; U.S. Pat. No. 5,269,032 to Flocks; U.S. Pat. No. 6,374,440 to Thim, Jr.; U.S. Pat. No. 7,024,709 to Moceri; U.S. Pat. No. 7,346,948 to Swezey et al.; U.S. Patent Application Publication No. 2009/0288253 to Jin). This can not be achieved without significant alterations and often damages to the existing frame, or may be impossible without the help of a welder in the case of a metal frame. Furthermore, the customer is limited to the existing size of the bed frame and cannot easily expand or contract the headboard frame to suit a new, different size for mattress and bed structure.

U.S. Pat. No. 6,543,071 to Lenner describes incorporating interchangeable panels or U.S. Patent Application Publication No. 2010/0281615 to Truex describes headboard/footboard covers for a bed for an existing bed frame. While these alternatives do not damage a bed frame, they do not offer the variety of artistic expression and flexibility in bringing art into the bedroom, as described in the present invention.

U.S. Patent Application Publication No. 2003/0135928 to Murphy et al.; U.S. Pat. No. 6,182,307 to Rutrick; U.S. Pat. No. 6,371,190 to Owens; U.S. Pat. No. 6,618,876 to Murphy et al.; and U.S. Pat. No. 7,118,179 to Wilson et al., describe wall-mounted decorations of a fixed size.

It is desirable to provide means to maintain current home decorating trends and seasonal themes without significant financial or time investment. It is also desirable to change the appearance of the bed, and thereby the expression of the complete bedroom, without limitations of, or damage to, existing headboards. It is further desirable to provide a high level of consumer control and allow the consumer to easily incorporate very personal style elements, such as children's drawings and/or personal photographs, into decorating their bedroom.

SUMMARY OF THE INVENTION

The present invention is directed toward providing an improved headboard for the head of a bed. One objective of the present invention is to provide a decorative, lightweight, knock-down slipcovered headboard that is wall-mounted and independent of existing bed frame. The advantage is a custom look without alterations or damages to an existing bed structure.

Another objective of the present invention is to provide a headboard that is a slipcover with the flexibility to update a bedroom with ease and without much expense. The advantage of the present invention is to provide customization of slipcovers to suit personal taste without the difficulty and cost of conventional customized headboards.

Another objective of the present invention is to provide slipcovers that are easily mounted, dismounted and changed. The advantage is ease of use for the consumer.

Another object of the present invention is to provide a headboard that incorporates art into the bed and thus offers a solution to the problem of hanging art above the bed. The advantage of printed slipcovers adds flexibility of use to integrate individual designs and art into the bedroom and specifically above the bed.

Another objective of the present invention is to offer a headboard that can easily be adapted in size to the desired width of the bed structure, bed frame or mattress. A modular design with two base modules allows for frame elements to be combined in a way to adapt the frame width to the desired mattress width without having to purchase or construct a new frame. The present invention can be used with Twin, Full, Queen and King size beds, depending solely on the number of center modules used. The advantage is that it saves time and cost to the homeowner when a life situation calls for a larger or smaller bed for a family member.

Yet another advantage of present invention is to allow homeowner to clean, wash and sanitize all elements of the headboard with the advantage of achieving a clean and bug free environment. Both the pad and the slipcover are removable for washing and allow access to the frame for thorough cleaning.

Finally, the objective of present invention is to provide a kit for a headboard assembly in which frame members, pad and cover may be shipped and stored in a collapsed condition until ready for assembly. This has the advantage that the headboard can ship and transport in the most space- and the most cost-effective way, resulting in lower costs for the buyer and homeowner. This is achieved by packing the modules into a compact box. Each headboard assembly comprises right and left members, up to three center sections, hardware for screwing the frame together and mounting wooden hooks to the wall, a cushioning pad, a fabric slipcover, and written instructions. Assembly of the frame can use three screws (for Twin size frame), six screws (for Full size frame), nine screws (for Queen size frame) or a maximum of 12 screws (for King size frame) bed.

A specific objective of this invention is for the back side of the headboard to have horizontal dowels that slide on to wall-mounted wooden hooks, allowing for flexibility in mounting the hooks in the strongest place on the wall. This has the advantage of the least amount of damage to the wall, while allowing the headboard to slide horizontally to be centered above the bed.

In conventional headboard cover assemblies, the slipcover must be unstapled or unscrewed from the headboard then a new or cleaned cover is hammered, screwed or stapled into the headboard. One of the many advantages of the present invention is simple use. The cover slips right over the existing headboard and does not require any tools, snaps or ties. Children, those with minimum amount of skill, and those with arthritis or other physical limitations can easily use the slipcover. Testing has shown that this ability to give a "new look" to a headboard can be easily accomplished in no more than 10 minutes, requiring a minimum amount of skill.

Other objects, advantages and salient features of the invention will become apparent from the following, detailed description, which, taken in conjunction with the annexed drawings, discloses a preferred embodiment of the present invention.

The invention will be more fully described by reference to the following drawings.

BRIEF DESCRIPTION OF THE DRAWINGS

FIG. 3A is a schematic view of the wall-hanging mechanism including dowels that the headboard frame can slip on to.

DETAILED DESCRIPTION

Figure 1:
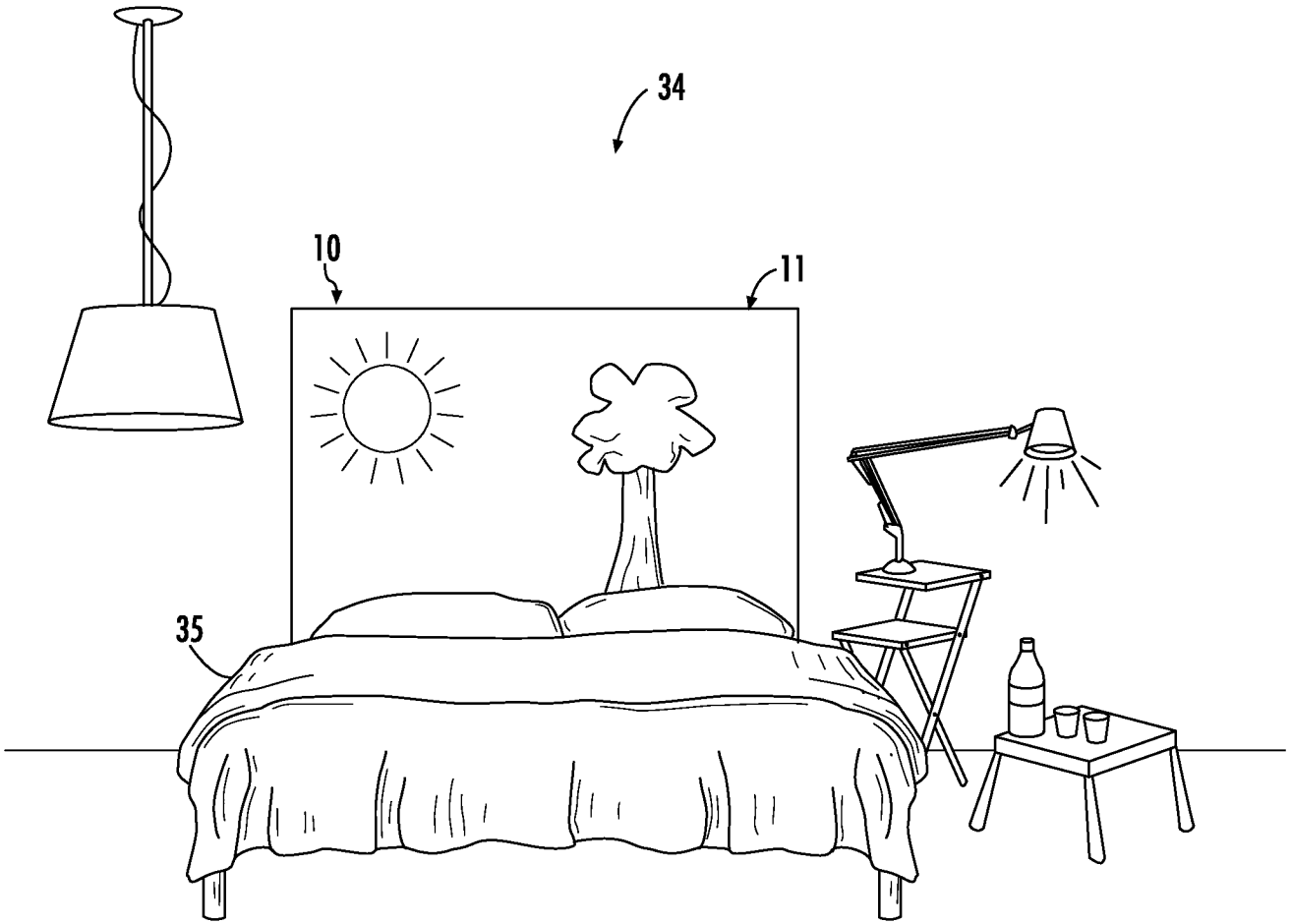
FIG. 1 is a front view of a headboard with artistic slipcover.

Reference will now be made in greater detail to a preferred embodiment of the invention, an example of which is illustrated in the accompanying drawings. Wherever possible, the same reference numerals will be used throughout the drawings and the description to refer to the same or like parts.

The following description of the performed embodiment (s) is merely exemplary in nature and is in no way intended to limit the invention, its application, or uses.

Embodiment of this invention relates to wall-mounted slipcover headboards. The headboard cover can be purchased individually, changed regularly to secure both a clean and hygienic headboard as well as create an updated and personal bed decorating system. Embodiments of this invention can be used for Twin, Full, Queen, King or custom sized headboards. The detailed description of the removable slipcover is applicable to a headboard according to embodiment of this invention.

Figure 2A:
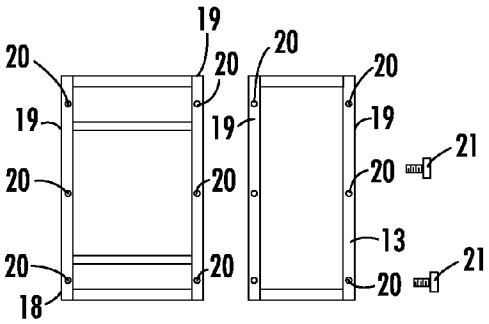
FIGS. 2A-2E are rear views of the headboard frame in various configurations.

Slipcovered headboard assembly 10 in accordance with the teachings of the present invention, is shown in FIG. 1. Slipcovered headboard assembly 10 can include frame 11 formed of one or more modular side frame members 12 and modular center frame members 13, as shown in FIG. 2A. Modular side frame members 12 and modular center frame members 13 can be coupled to one another in a predetermined arrangement to correspond to a particular dimension of a bed. Modular side frame members 12 include one or more support rails 14. For example, support rails 14 can be dowels.

Apertures 20 are formed inside surfaces 17 of modular side frame members 12 and side surfaces 19 of modular center frame members 13. Attachment members 21 are received in apertures 20 at respective locations for assembling one or more of adjacent ones modular side frame members 12 and modular center frame members 13 to one another. In one embodiment, attachment members 21 are screws. In the preferred embodiment, the screws are alien screws, having a captive screw or bolt, such as a screw with a hexagonal hole in the head combined with fasteners designed for ease of installation—often knurled for finger use—and retained within their functional environment when not engaged. Captive screw or bolt retention prevents loss or damage within the captive screw's parent assembly, or damage to components in the nearby working environment. The screw and captive bolt can connect apertures 20 of adjacent modular side frame members 12 or modular center frame members 13.

Frame 11 can be formed using one of modular side frame members 12 as a left-hand side and a right-hand side member, which are basically the same regardless of whether frame 11 is to be made into a Twin, Full, Queen or King size headboard. In one embodiment, modular side frame member 12 has a width $W_1$ of about 20 inches and modular center frame member 13 has a width $W_2$ of about 12 inches. An appropriate number of modular side frame members 12 and modular center frame members 13 center sections can be coupled to one another to form frame 11 of an appropriate size. Support surface 18 can be attached to a front surface of frame 11 of modular side frame members 12 and modular center frame members 13. For example, support surface 18 can be made of plywood. For example, frame 11 can be formed of hard wood.

Figure 2B:
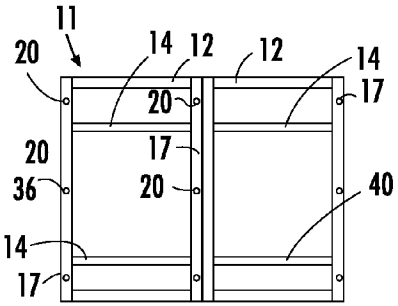

FIG. 2B illustrates a twin frame embodiment including a pair of modular side frame members 12 connected to one another with a plurality of attachment members 21. No modular center frame members 13 are used in this embodiment. For example, three attachment members 21 can be used in this embodiment.

Figure 2C:
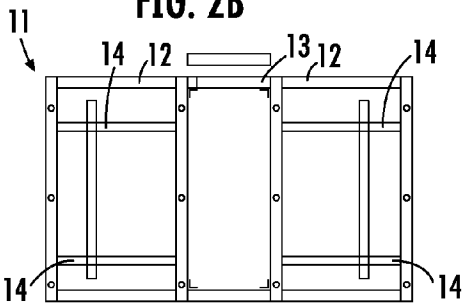

FIG. 2C illustrates a full frame embodiment including a pair of modular side frame members 12. One modular center frame member 13 is connected between the pair of modular side frame members 12 with a plurality of attachment members 21. For example, six attachment members 21 can be used in this embodiment.

Figure 2D:
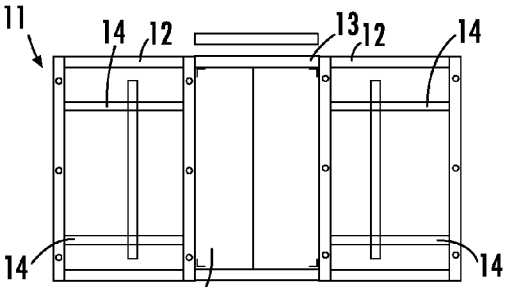

FIG. 2D illustrates a queen frame embodiment including a pair of modular side frame members 12. Two modular center frame members 13 are connected between the pair of modular side frame members 12 with a plurality of attachment members 21. For example, nine attachment members 21 can be used in this embodiment.

Figure 2E:
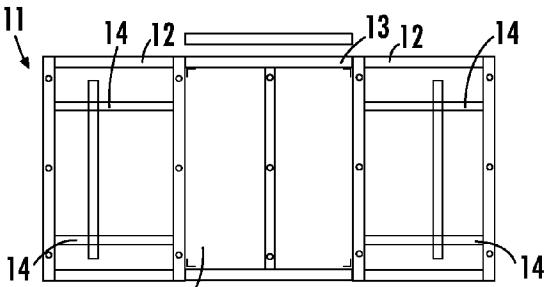

FIG. 2E illustrates a king frame embodiment including a pair of modular side frame members 12. Three modular center frame members 13 are connected between the pair of modular side frame members 12 with a plurality of attachment members 21. For example, twelve attachment members 21 can be used in this embodiment.

For example, a typical width and height dimensions are for a Twin 40 inches in length and 36 inches in height; Full 52"×36"; Queen 64"×36" and King 76"×36". A daybed equals one King and two Twins. More particularly, a daybed has a headboard along the longside, or a sideboard, combined with two bolster pillows. This turns a daybed into a reading nook or cove for a child or young adult.

Figure 3A:
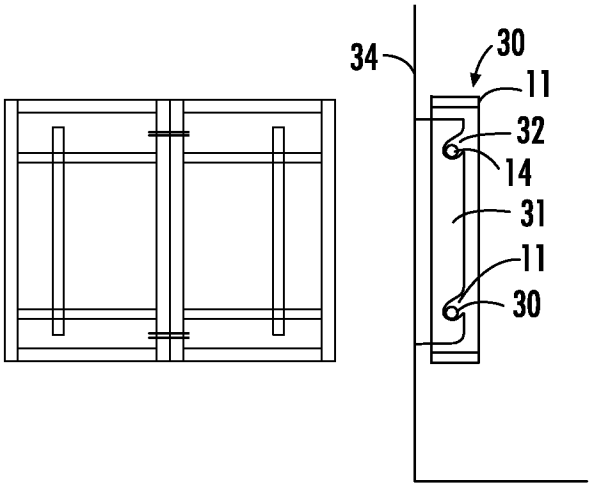
Figure 3B:
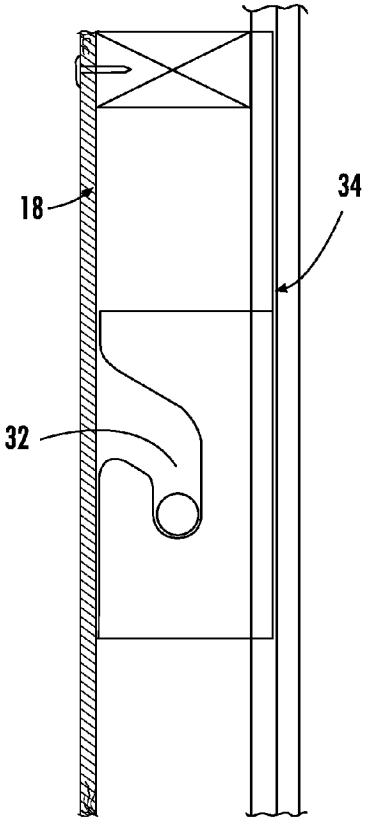
FIG. 3B is a perspective view of a portion of the wall-hanging mechanism.

Slipcovered headboard assembly 10 can include hanging mechanism 30 for attaching slipcovered headboard assembly 10 to support 34, such as a wall, as shown in FIG. 3A. Front side 31 of hanging mechanism 30 includes openings 32. For example, openings 32 can have a U-shape. Support rails 14 can be received within openings 32 and supported therein. Preferably, two openings 32 are positioned in hanging mechanism 30 for receiving and supporting respective support rails 14. During use, a pair of hanging mechanisms 30 can be attached to support 34. Support rails 14 can slide horizontally within openings 32 in order to place frame 11 at a desired location. Referring to FIG. 1, slipcovered headboard assembly 10 in accordance with the present invention, is preferably mounted on support 34, such as a wall above bed 35, but can be mounted above any piece of furniture, such as a couch, or simply mounted on the wall with no furniture underneath. Slipcovered headboard assembly 10 is separate from the bed frame (not shown) and the bed and therefore can be purchased and moved separately and does not require assembly with the bed frame in order to use the headboard.

Figure 4A:
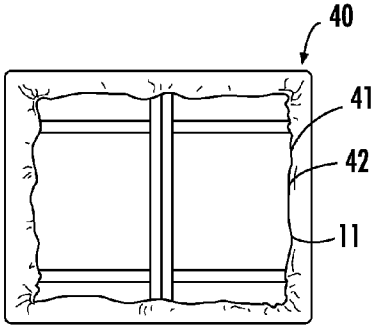
FIG. 4A is a schematic diagram of a cushioning pad used in the headboard.

Slipcovered headboard assembly 10 can include cushioning pad 40, as shown in FIG. 4A. Cushioning pad 40 can be received over frame 11. Cushioning pad 40 can have a flexible band 42 adjacent edge 41. For example, flexible band 42 can be formed of elastic. Suitable materials for cushioning pad 40 can include, but are not limited to, quilted cotton with a synthetic core similar to a mattress cover material. As will be appreciated, by stretching cushioning pad 40 taut, by sewing flexible band 42 into the seams of cushioning pad 40, the end result is to pad the frame with a snug fitting pad that softens frame 11 to the touch and to recline against.

Figure 4B:
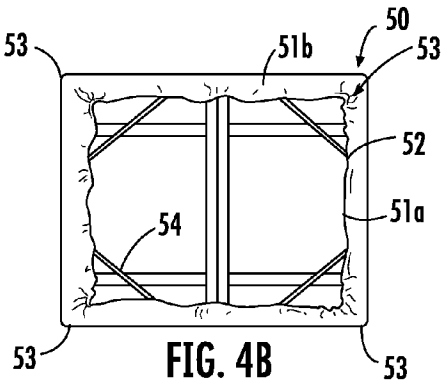
FIG. 4B is a schematic view of a slipcover used with the headboard.
Figure 4C:
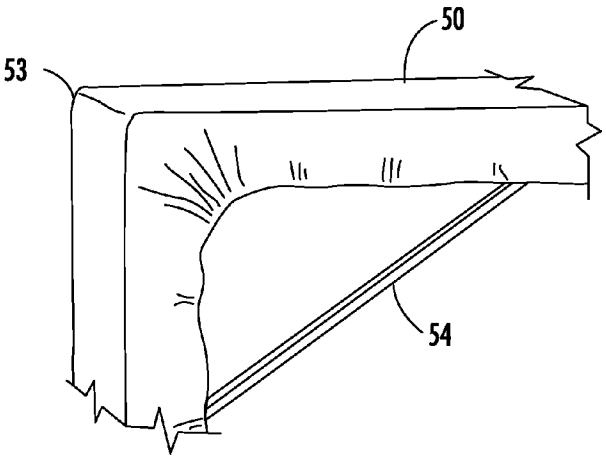
FIG. 4C is a schematic diagram of a corner of the slipcover shown in FIG. 4B.

Slipcovered headboard assembly 10 can include slipcover 50, as shown in FIG. 4B. Slipcover 50 can be slipped over cushioning pad 40 and frame 11. Slipcover 50 can have a flexible band 52 adjacent edge 51. For example, flexible band 52 can be formed of elastic. Suitable fabrics for slipcover 50 can include, but are not limited to, cotton, linen, woolens, satin, fleece, LYCRA®, flannel, velvet, denim, corduroy, silk and polyester, or a blend or mentioned fibers. It is not beyond the scope of embodiments of this invention that the materials used also include leather, vinyl, or plastic.

Slipcover 50 is of such size and dimensions that, when in place, it is snug around frame 11, while slipcover 50 is slightly stretched. Using a soft elastic band for flexible band 52 allows slipcover 50 to fit closely on slipcovered headboard assembly 10 and prevents slippage of slipcover 50 without damaging or marking slipcovered headboard assembly 10. When slipcover 50 is changed, flexible band 52 facilitates non-abrasive removal and replacement of slipcover 50.

Corners 53 of slipcover 50 can include corner elastic member 54 extending between adjacent edges 51*a*, 51*b*. Corner elastic member 54 can be sewn into adjacent edges 51*a*, 51*b* at predetermined positions to provide additional tension necessary for snug fit of slipcover 50. Corner elastic member 54 can be formed of elastic. Corner elastic member 54 are sewn into adjacent edge 51 to tautly secure slipcover 50 when slipcover 50 is slipped over frame 11 and provide a flat surface of slipcover 50.

Slipcover 50 may be provided with any type of decorative fabric pattern which may be woven, imprinted or emplaced upon the fabric cover in any other conventional manner.

Slipcovered headboard assembly 10 can be formed as a ready to assemble kit. The kit can include any number of modular side frame members 12 and modular center frame members 13, for example, frame 11 as one of the embodiments, as shown in FIGS. 2A-2E. The kit can also include attachment members 21, hanging mechanism 30, cushioning pad 40 and slipcover 50.

From the description above, a number of advantages of slipcovered headboard assembly 10 become evident:

The customization of designs extend the life of the headboard and hence the bed by adapting to several ages, genders, tastes, styles and seasons.

The customized slipcovers can be purchased separately and offer the consumer a variety of designs, including personal imagery, and luxury of choice.

The modular frame can be produced of sustainable, economical materials and therefore keep consumer costs down.

The pre-assembled shipping of frame, pad and slipcover in one compact box keeps shipping costs down for the consumer and eases the carbon footprint of presented invention compared to conventional headboards which are shipped in large crates.

The use of customized slipcover headboards attached to the wall will provide flexibility for the consumer to alter use from age, gender and décor. This system provides a solution to bringing art into the bedroom and above the bed that is artistic and economical.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A slipcovered headboard assembly adapted to be supported independently of connection to any portion of an adjacent bed, said headboard assembly comprising:

a frame comprising a plurality of modular side frame members, said side frame members including a pair of support dowels on a rear surface thereof, and one or more modular center frame members, one or more attachment members for attaching adjacent side frame members and/or center frame members together to form a frame;

a pair of hanging mechanisms, each of the hanging mechanisms including a pair of openings, said openings having a U-shape, each said support dowels is horizontally slidably received in one of said openings of each of the pair of said hanging mechanisms, each of the hanging mechanisms adapted to be attached to a wall;

a removable cushioning pad sized to fit tightly over the frame; and a removable slipcover, the removable slipcover includes a corner elastic member extending between predetermined positions of adjacent edges of said slipcover and a flexible band extending around the edge of the slipcover, the corner elastic members and the flexible band provide tension thereby providing a snug fit of the removable slip cover and a substantially flat surface of the removable slipcover after the removable slipcover is received over the cushioning pad and frame;

wherein a predetermined number of said center frame members are included in the frame to provide a desired width of the headboard.

2. The headboard assembly according to claim 1, wherein said cushioning pad is formed of quilted and washable fabric.

3. The headboard assembly according to claim 1, wherein the removable slipcover includes decorative indicia.

4. The headboard assembly according to claim 1, wherein the attachment members are screws.

5. The headboard assembly according to claim 1, wherein the attachment members are hexagonal socket screws.

6. A ready to assemble slipcovered headboard assembly kit for an expandable headboard comprising:

a frame comprising a plurality of modular side frame members, said side frame members including a pair of support dowels on a rear surface thereof, and one or more modular center frame members, one or more attachment members for attaching adjacent side frame members and/or center frame members together to form a frame;

a pair of hanging mechanisms, each of the hanging mechanisms including a pair of openings, said openings having a U-shape, each said support dowels is horizontally slidably received in one of said openings of each of the pair of said hanging mechanisms, each of the hanging mechanisms adapted to be attached to a wall;

a removable cushioning pad sized to fit tightly over the frame; and a removable slipcover, the removable slipcover includes a corner elastic member extending between predetermined positions of adjacent edges of said slipcover and a flexible band extending around the edge of the slipcover, the corner elastic members and the flexible band provide tension, thereby providing a snug fit of the removable slip cover and a substantially flat surface of the removable slipcover after the removable slipcover is received over the cushioning pad and frame;

wherein a predetermined number of said center frame members are included in the frame to provide a desired width of the headboard.

7. The headboard assembly kit according to claim 6 wherein the removable slipcover includes decorative indicia.

8. The headboard assembly kit according to claim 6 wherein the frame is assembled as a twin size, a queen size, or a king size.

9. The headboard assembly according to claim 6, wherein the attachment members are hexagonal socket screws.

* * * * *